US012031460B2

(12) United States Patent
Weidauer

(10) Patent No.: US 12,031,460 B2
(45) Date of Patent: Jul. 9, 2024

(54) SLIDING CAM SYSTEM

(71) Applicants: thyssenkrupp Dynamic Components GmbH, Ilsenburg (DE); thyssenkrupp AG, Essen (DE)

(72) Inventor: Marcel Weidauer, Chemnitz (DE)

(73) Assignees: thyssenkrupp Dynamic Components GmbH, Ilsenburg (DE); thyssenkrupp AG, Essen (DE)

( * ) Notice: Subject to any disclaimer, the term of this patent is extended or adjusted under 35 U.S.C. 154(b) by 0 days.

(21) Appl. No.: 18/020,781

(22) PCT Filed: Aug. 10, 2021

(86) PCT No.: PCT/EP2021/072306
§ 371 (c)(1),
(2) Date: Feb. 10, 2023

(87) PCT Pub. No.: WO2022/034104
PCT Pub. Date: Feb. 17, 2022

(65) Prior Publication Data

US 2024/0035398 A1 Feb. 1, 2024

(30) Foreign Application Priority Data

Aug. 12, 2020 (DE) ..... 10 2020 210 259.7

(51) Int. Cl.
*F01L 1/344* (2006.01)
*F01L 1/047* (2006.01)
(Continued)

(52) U.S. Cl.
CPC ..... *F01L 1/344* (2013.01); *F01L 1/047* (2013.01); *F01L 1/053* (2013.01); *F01L 1/46* (2013.01);
(Continued)

(58) Field of Classification Search
CPC ..... F01L 1/047; F01L 2001/0471; F01L 2001/0473; F01L 1/053; F01L 1/344;
(Continued)

(56) References Cited

U.S. PATENT DOCUMENTS 8,960,143 B2 2/2015 Meintschel et al.
9,249,697 B2 2/2016 Doller
(Continued)

FOREIGN PATENT DOCUMENTS

DE 10 2007 010 149 A1 9/2008
DE 102007037747 A1 2/2009
(Continued)

OTHER PUBLICATIONS

English Translation of International Search Report issued in PCT/EP2021/072306, dated Nov. 16, 2021.

*Primary Examiner* — Loren C Edwards
(74) *Attorney, Agent, or Firm* — thyssenkrupp North America, LLC

(57) ABSTRACT

A sliding cam system for an internal combustion engine includes an adjusting element that has at least three coupling pins. A first coupling pin is arranged in the region of the primary sliding cam element and a second coupling pin is arranged in the region of the first secondary sliding cam element and a third coupling pin is arranged in the region of the second secondary sliding cam element. The coupling pins each cooperate with a shifting gate of the respectively associated sliding cam element such that a movement of a primary sliding cam element initiated by the actuator pin is transmissible to secondary sliding cam elements by the adjusting element. The sliding cam system is designed such that a shifting operation of the first secondary sliding cam
(Continued)

element takes place at least partially at the same time as the shifting operation of the second secondary sliding cam element.

15 Claims, 13 Drawing Sheets

(51) Int. Cl.
*F01L 1/053* (2006.01)
*F01L 1/46* (2006.01)
*F01L 13/00* (2006.01)

(52) U.S. Cl.
CPC ..... *F01L 13/0015* (2013.01); *F01L 13/0036* (2013.01); *F01L 2001/0473* (2013.01); *F01L 2013/001* (2013.01); *F01L 2013/0052* (2013.01); *F01L 2013/0078* (2013.01)

(58) Field of Classification Search
CPC ..... F01L 1/46; F01L 13/001; F01L 13/0015; F01L 13/0036; F01L 2013/0052; F01L 2013/0078
See application file for complete search history.

(56) References Cited

U.S. PATENT DOCUMENTS

| | | | |
|---|---|---|---|
| 10,260,380 | B2 | 4/2019 | Schmidt et al. |
| 2017/0321575 | A1 | 11/2017 | Wetzel |

FOREIGN PATENT DOCUMENTS

| | | | | |
|---|---|---|---|---|
| DE | 102007052249 | A1 | 5/2009 | |
| DE | 102008005639 | A1 | 7/2009 | |
| DE | 102008050776 | A1 | 4/2010 | |
| DE | 102008060166 | A1 | 6/2010 | |
| DE | 102010004591 | A1 | 7/2011 | |
| DE | 102010021903 | A1 | 12/2011 | |
| DE | 102011001123 | A1 | 9/2012 | |
| DE | 102011002141 | A1 | 10/2012 | |
| DE | 102011078434 | A1 | 1/2013 | |
| DE | 102011053333 | A1 | 3/2013 | |
| DE | 10 2011 054218 | A1 | 4/2013 | |
| DE | 102011054218 | A1 | 4/2013 | |
| DE | 102011054218 | A1 * | 4/2013 | ..... F01L 1/053 |
| DE | 102011116653 | A1 | 4/2013 | |
| DE | 102011085702 | A1 | 5/2013 | |
| DE | 102012022123 | A1 | 5/2013 | |
| DE | 102011121684 | A1 | 6/2013 | |
| DE | 102012022208 | A1 | 6/2013 | |
| DE | 102012008555 | B4 | 10/2013 | |
| DE | 102012112795 | A1 | 6/2014 | |
| DE | 102013009757 | A1 | 12/2014 | |
| DE | 102013111410 | A1 | 4/2015 | |
| DE | 102013113348 | A1 | 6/2015 | |
| DE | 102013113349 | | 6/2015 | |
| DE | 102014007189 | A1 | 11/2015 | |
| DE | 102014216058 | A1 | 2/2016 | |
| DE | 102015220602 | A1 | 4/2017 | |
| DE | 102016204892 | A1 | 9/2017 | |
| DE | 102016005454 | A1 | 11/2017 | |
| DE | 102018111942 | A1 | 11/2019 | |
| DE | 102018112414 | A1 | 11/2019 | |
| DE | 102018112415 | A1 | 11/2019 | |
| DE | 102018112416 | A1 | 11/2019 | |
| DE | 102018112417 | A1 | 11/2019 | |
| DE | 102018112419 | A1 | 11/2019 | |
| DE | 102019102103 | A1 | 11/2019 | |
| DE | 10 2019 107 626 | A1 | 10/2020 | |
| EP | 2132418 | B1 | 12/2009 | |
| EP | 2 181 251 | B1 | 5/2010 | |
| EP | 2 331 795 | B1 | 6/2011 | |
| EP | 2585687 | B1 | 5/2013 | |
| EP | 2676015 | B1 | 12/2013 | |
| EP | 2823159 | B1 | 1/2015 | |
| EP | 2 859 199 | B1 | 4/2015 | |
| EP | 3365537 | B1 | 8/2018 | |
| JP | 2012-505 333 | A | 3/2012 | |
| WO | 2016177479 | A1 | 11/2016 | |
| WO | 2017/067549 | A1 | 4/2017 | |
| WO | 2018/195370 | A1 | 10/2018 | |
| WO | 2018195370 | A1 | 10/2018 | |
| WO | 2020/193560 | A1 | 10/2020 | |

* cited by examiner

Prior Art

SLIDING CAM SYSTEM

CROSS REFERENCE TO RELATED APPLICATIONS

This application is a U.S. National Stage Entry of International Patent Application Serial Number PCT/EP2021/072306, filed Aug. 10, 2021, which claims priority to German Patent Application No. DE 10 2020 210 259.7, filed Aug. 12, 2020, the entire contents of which are incorporated herein by reference.

FIELD

The present disclosure generally relates to a sliding cam system for an internal combustion engine.

BACKGROUND

A sliding cam system of the abovementioned type is known for example from German Patent Application No. DE 10 2011 054 218 A1.

In the known sliding cam system, a rotatably mounted camshaft is provided. The camshaft comprises a plurality of sliding cams. The sliding cams are axially movable. The axial movement of the sliding cams is initiated by an actuator.

To this end, a coupling rod is fixedly connected via a shifting fork to a sliding cam which is axially moved directly by the actuator. During an axial movement of the sliding cam, the coupling rod moves with the sliding cam.

The coupling rod comprises gates. The gates are fixedly connected to the coupling rod. The gates are each associated with a further sliding cam. The further sliding cams have pins which cooperate with the respectively associated cams such that the further sliding cams are moved in accordance with the movement of the sliding cam fixedly connected to the coupling rod.

The applicant's patent application PCT/EP2020/058182, or DE 10 2019 107 626.9, discloses a sliding cam system for an internal combustion engine having at least one camshaft, comprising a carrier shaft with at least two sliding cam elements. The sliding cam elements each comprise a shifting gate with at least one shifting groove, wherein the sliding cam elements are displaceable axially with respect to the carrier shaft by at least one actuator pin. Arranged parallel to a longitudinal axis of the carrier shaft is at least one adjusting element, wherein the adjusting element is axially displaceable in the direction of the longitudinal axis of the carrier shaft.

Although an advantageous sliding cam system is already proposed therein, it is still possible to make improvements, in particular with regard to the maximum shifting speed and the masses to be moved.

Thus, in the prior art, in particular in the sliding cam system according to PCT/EP2020/058182, or DE 10 2019 107 626.9, the displacement region of the shifting grooves is limited to in each case 120°NW, this ultimately representing the groove length of the respective sliding cam element that is used for displacement. The masses to be moved of the sliding camshaft and ultimately the maximum shifting speed are in turn limited by the resultant kinematics.

Thus a need exists for an improved sliding cam system, in particular of specifying a sliding cam system in which axial displacement of a sliding cam element at an increased speed and/or axial displacement of a sliding cam element with a greater mass can be achieved.

DETAILED DESCRIPTION

Figure 1:
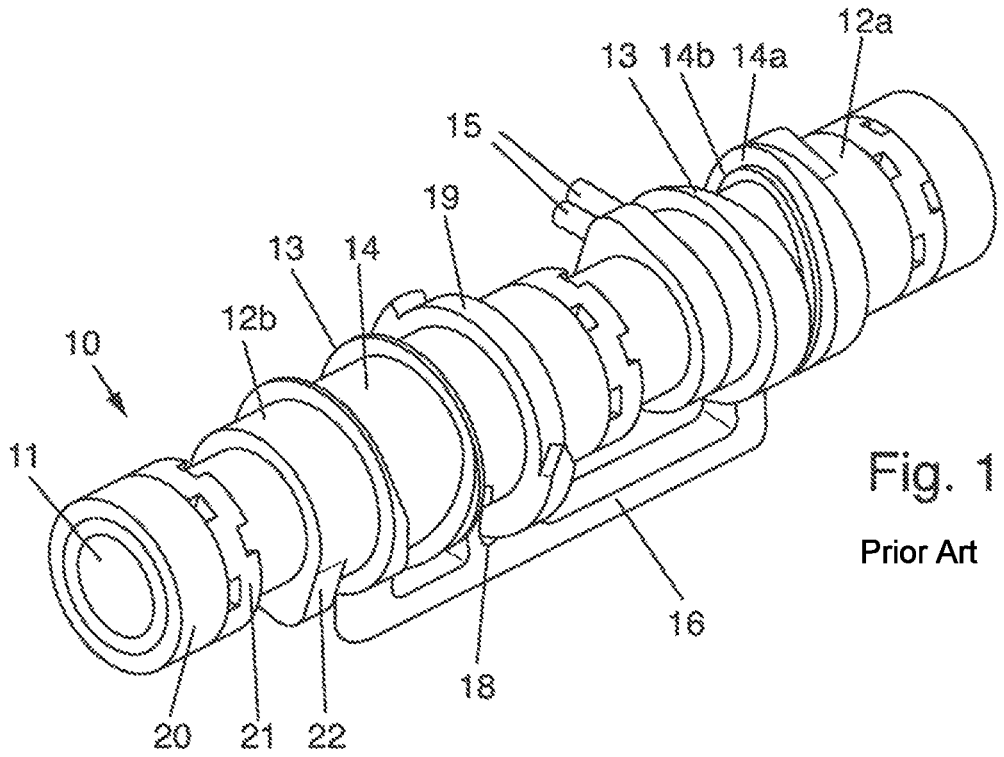
Fig. 1 Prior Art
FIG. 1 is a perspective view of an exemplary embodiment of a sliding cam system according to the prior art.
Figure 2:
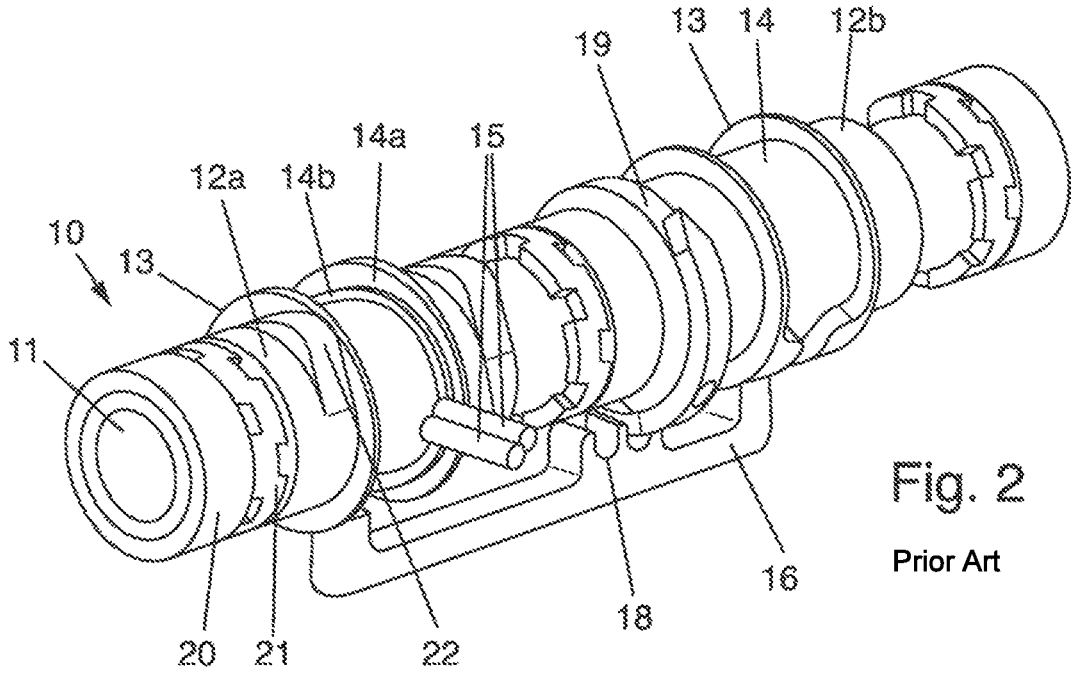
Fig. 2 Prior Art
FIG. 2 is a further perspective view of an exemplary embodiment of a sliding cam system according to the prior art.
Figure 3:
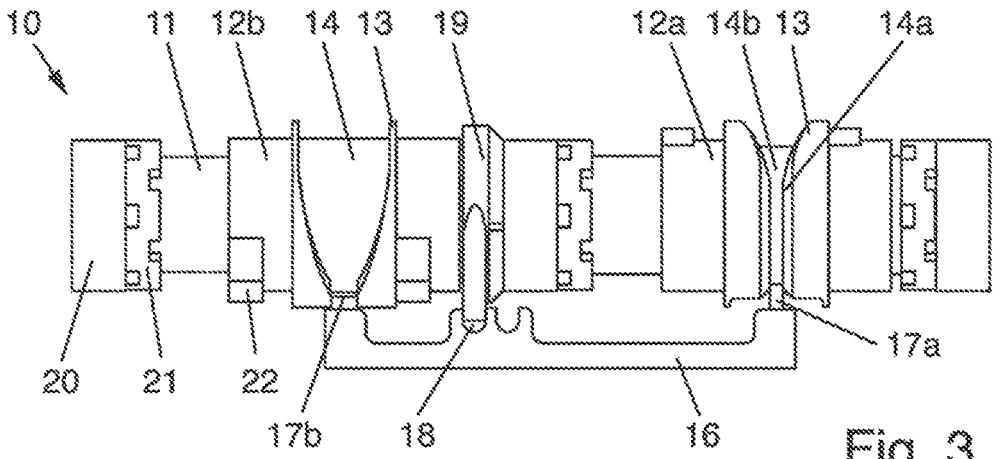
Fig. 3 Prior Art
FIG. 3 is a side view of an exemplary embodiment of a sliding cam system according to the prior art.
Figure 4:
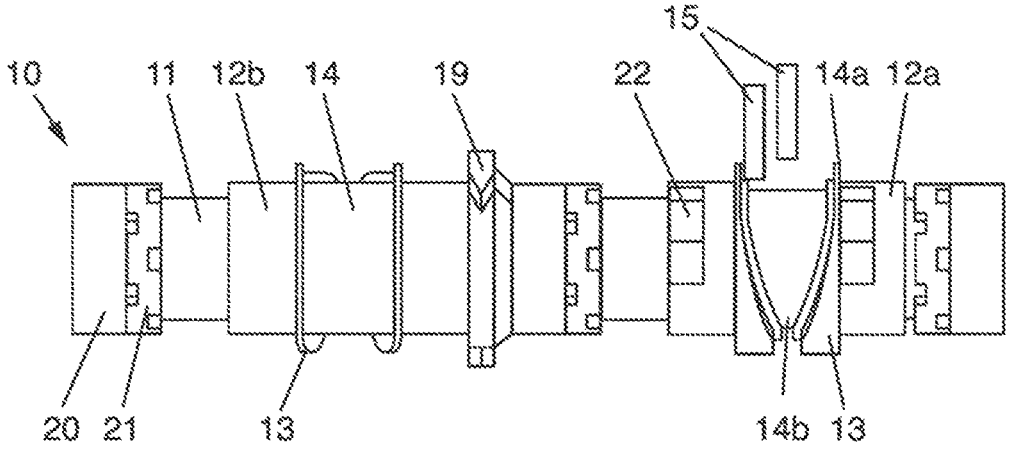
Fig. 4 Prior Art
FIG. 4 is a further side view of an exemplary embodiment of a sliding cam system according to the prior art.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims.

In addition, all references to one skilled in the art shall be understood to refer to one having ordinary skill in the art.

Since the sliding cam system is designed such that a shifting operation of first secondary sliding cam element takes place at least partially at the same time as the shifting operation of the secondary sliding cam element, the sliding region can be enlarged and thus axial displacement of a sliding cam element at an increased speed and/or axial displacement of a sliding cam element with a greater mass can be achieved compared with a known sliding cam system.

Further advantageous configurations of the proposed invention can be found in particular in the features of the dependent claims. The subjects or features of the different claims can in principle be combined with one another as desired.

In one advantageous configuration of the invention, it may be provided that the sliding cam system is designed such that the shifting operation of a first secondary sliding cam element begins immediately after the end of the shifting operation of the primary sliding cam element, and that the shifting operation of a second secondary sliding cam element begins after the beginning and before the end of the shifting operation of the first secondary sliding cam element.

In a further advantageous configuration of the invention, it may be provided that the sliding cam system is designed such that the beginning of the shifting operation of a first secondary sliding cam element and the beginning of the shifting operation of a second secondary sliding cam element take place at the same time.

In a further advantageous configuration of the invention, it may be provided that the lengths of the displacement regions of the sliding cam elements are the same, in particular that °NW 121*a*/S=°NW 121*b*/S=°NW 121*c*/S.

In a further advantageous configuration of the invention, it may be provided that the lengths of the displacement regions of all the sliding cam elements are different, in particular that °NW 121*a*/S≠°NW 121*b*/S≠°NW 121*c*/S.

In a further advantageous configuration of the invention, it may be provided that the displacement regions of the sliding cam elements are greater than 120°NW, in particular that °NW 121*a*/S>120° and °NW 121*b*/S>120° and °NW 121*c*/S>120°, respectively.

In a further advantageous configuration of the invention, it may be provided that the beginning of the shifting portion °NW121*b*/SA with respect to the cam start °NW122*b*/NA is not the same as the beginning of the shifting portion °NW121*c*/SA with respect to the cam start °NW122*c*/NA, in other words that the angular position of the displacement region with respect to the respective cam tip is different for the secondary sliding cam elements, in particular that °NW121*b*/SA with respect to °NW122*b*/NA is not the same as °NW121*c*/SA with respect to °NW122*c*/NA.

In a further advantageous configuration of the invention, it may be provided that the length of the displacement region of the first shifting groove on the primary sliding cam element is greater than the length of the displacement regions of the shifting grooves on the secondary sliding cam elements.

In a further advantageous configuration of the invention, it may be provided that the length of the displacement region of the shifting groove on at least one secondary sliding cam element is greater than the length of the displacement region on the primary sliding cam element and/or possibly further secondary sliding cam elements.

In a further advantageous configuration of the invention, it may be provided that more than two secondary sliding cam elements are coupled to a connecting element.

In a further advantageous configuration of the invention, it may be provided that the secondary sliding cam elements are not identical parts, in particular in terms of the displacement region and/or cam contour.

In a further advantageous configuration of the invention, it may be provided that the cam contours of the secondary sliding cam elements are arranged identically, in particular are arranged so as to be offset at an angle, for example offset at 120°, only in accordance with the ignition sequence, and are embodied identically with regard to the cam contour. However, depending on the thermodynamic demand, both the arrangement and the cam profile shape/cam profile length may differ.

In a further advantageous configuration of the invention, it may be provided that the sliding cam system is designed such that the shifting operation of the primary sliding cam element ends before the shifting operation of a second secondary sliding cam element takes place. Preferably, the displacement of the primary sliding cam element takes place only while the blocking disk is unblocked and the displacement of the secondary cam elements can preferably take place only when the blocking disk is blocked.

In a further advantageous configuration of the invention, it may be provided that the sliding cam system is designed such that the shifting operation of a first secondary sliding cam element begins immediately after the end of the shifting operation of the primary sliding cam element, wherein in particular the shifting operation of a further (second) secondary sliding cam element begins preferably after the beginning and before the end of the shifting operation of the first secondary sliding cam element.

THE FOLLOWING REFERENCE SIGNS ARE USED IN THE DRAWINGS BELOW

10 Camshaft
11 Carrier shaft
12*a* Primary sliding cam element
12*b* First secondary sliding cam element
12*c* Second secondary sliding cam element
13 Shifting gate
14 Shifting groove
14*a* First shifting groove
14*b* Second shifting groove
15 Actuator pin
16 Adjusting element
17*a* First coupling pin
17*b* Second coupling pin
17*c* Third coupling pin
18 Receiving element
19 Locking element
20 Rolling bearing
21 Retaining rings
22 Cam contour
23 Actuator
24 Blocking region of blocking disk
25 Full lift profile cylinder.1 (FL profile cyl. 1)
26 Full lift profile cylinder.3 (FL profile cyl. 3)
27 Full lift profile cylinder.2 (FL profile cyl. 2)
28 Partial lift profile cylinder.1 (PL profile cyl. 1)
29 Partial lift profile cylinder.3 (PL profile cyl. 3)
30 Partial lift profile cylinder.2 (PL profile cyl. 2)
31 Axial lift cylinder.1
32 Axial lift cylinder.2
33 Axial lift cylinder.3
34 Region of simultaneity of the axial movement of the secondary sliding cam elements (BG)

121*a* First shifting groove of the primary sliding cam element 12*a*

121*a*" Second shifting groove of the primary sliding cam element 12*a*

121*b* Shifting groove of the first secondary sliding cam element 12*b*

121*c* Shifting groove of the second secondary sliding cam element 12*c*

122*a* First cam contour of the primary sliding cam element 12*a*

122*a*" Second cam contour of the primary sliding cam element 12*a*

122*b* First cam contour of the first secondary sliding cam element 12*b*

122*b*" Second cam contour of the first secondary sliding cam element 12*b*

122*c* First cam contour of the second secondary sliding cam element 12*c*

122*c*" Second cam contour of the second secondary sliding cam element 12*c*

°NW 121*a*/S Angular length of the displacement region 121*a*/S of the first shifting groove 121*a* of the primary sliding cam element 12*a*

°NW 121*a*/F Angular length of the freewheel 121*a*/F of the first shifting groove 121*a* of the primary sliding cam element 12*a*

°NW 121*b*/S Angular length of the displacement region 121*b*/S of the shifting groove 121*b* of the first secondary sliding cam element 12*b*

°NW 121*b*/F Angular length of the freewheel 121*b*/F of the shifting groove 121*b* of the first secondary sliding cam element 12*b*

°NW 121*c*/S Angular length of the displacement region 121*c*/S of the shifting groove 121*c* of the second secondary sliding cam element 12*c*

°NW 121*c*/F Angular length of the freewheel 121*c*/F of the shifting groove 121*c* of the second secondary sliding cam element 12*c*

°NW121*a*/SA Start of the displacement region of the first shifting groove 121*a* of the primary sliding cam element 12*a*

°NW121*a*/SE End of the displacement region of the first shifting groove 121*a* of the primary sliding cam element 12*a*

°NW121*b*/SA Start of the displacement region of the shifting groove 121*b* of the first secondary sliding cam element 12*b*

°NW121*b*/SE End of the displacement region of the shifting groove 121*b* of the first secondary sliding cam element 12*b*

°NW121*c*/SA Start of the displacement region of the shifting groove 121*c* of the second secondary sliding cam element 12*c*

°NW121*c*/SE End of the displacement region of the shifting groove 121*c* of the second secondary sliding cam element 12*c*

°NW122*b*/NA Start of the first cam contour 122*b* of the first secondary sliding cam element 12*b*

°NW122*c*/NA Start of the first cam contour 122*c* of the second secondary sliding cam element 12*c*

NS122*b* Cam tip of the first cam contour of the first secondary sliding cam element 12*b*

NS122*c* Cam tip of the first cam contour of the second secondary sliding cam element 12*c*

FIGS. 1 to 4 show the same exemplary embodiment of a sliding cam system from different perspectives.

The sliding cam system for an internal combustion engine having at least one camshaft 10 comprises a carrier shaft 11. A primary sliding cam element 12*a* and a first secondary sliding cam element 12*b* are arranged on the carrier shaft so as to be axially movable with respect to a longitudinal axis of the carrier shaft 11 and in particular for conjoint rotation. It is conceivable for more than two sliding cam elements to be arranged on the carrier shaft 11. The carrier shaft 11 comprises preferably three rolling bearings 20. One rolling bearing 20 is arranged on each of the axial ends of the carrier shaft 11 and a further rolling bearing 20 is arranged between the sliding cam elements 12*a*, 12*b*. The rolling bearings 20 are preferably locked by retaining rings 21. The number of rolling bearings 20 and of retaining rings 21 and the positions of the bearing points are variable. The sliding cam elements 12*a*, 12*b* comprise a shifting gate 13 and a cam contour 22.

The shifting gate 13 of the first sliding cam element 12*a* comprises a first and a second shifting groove 14*a*, 14*b*. The shifting grooves 14*a*, 14*b* are V-shaped at least in portions. In other words, the width of the two shifting grooves 14*a*, 14*b* is not constant. The width should be understood as being the distance between the flanks of the shifting grooves 14*a*, 14*b* in an axial direction with respect to the carrier shaft 11. The flanks of the shifting grooves 14*a*, 14*b* approach one another in the V-shaped portion.

The two shifting grooves 14*a*, 14*b* are preferably arranged at the same rotational angle. The first shifting groove 14*a* preferably has a larger radius than the second shifting groove 14*b*.

The radius should be understood as being the size of the distance of the groove bottom surface of the first or the second shifting groove 14*a*, 14*b* from the longitudinal center axis of the carrier shaft 11. Thus, the outside diameter of the shifting gate 13 and the radius of the groove bottom surface determine the groove depth.

The first shifting groove 14*a* preferably comprises a step. In other words, the first shifting groove 14*a* is in the form of a protrusion or shoulder. The first shifting groove 14*a* preferably has a varying radius. In other words, the first shifting groove 14*a* has, in portions, regions with a larger radius and regions with a smaller radius. The radius changes steplessly. The regions are each assigned to an entry region, an exit region and a displacement region.

The second shifting groove 14*b* preferably has a constant radius. The width of the second shifting groove 14*b* is smaller than the width of the first shifting groove 14*a*.

Two actuator pins 15 are arranged on the carrier shaft 11. The actuator pins 15 are movable substantially only in a direction orthogonal to the longitudinal center axis of the carrier shaft 11. The actuator pins 15 are assigned to the first shifting groove 14*a*. In other words, the actuator pins cooperate only with the first shifting groove 14*a*. The actuator pins 15 are spaced apart from one another in the axial direction of the carrier shaft 11. As a result, depending on the position of the primary sliding cam element, one of the two actuator pins 15 is introducible into the first shifting groove 14*a*. As a result of the introduction of the actuator pin 15, an axial movement of the primary sliding cam element 14*a* is able to be initiated.

To this end, an actuator pin 15 is introduced into the first shifting groove 14*a*. As a result of the reduction in the groove width, the introduced actuator pin 15 cooperates with a flank of the first shifting groove 14*a*. More specifically, the introduced actuator pin 15 exerts, on a flank of the first shifting groove 14*a*, a force directed counter to the flank. As a result, the axial displacement of the primary sliding cam element 12*a* takes place. The direction of the displacement thus depends on the flank with which the introduced actuator pin 15 cooperates. Each flank of the first shifting groove 14*a* is assigned an actuator pin 15.

Arranged parallel to the carrier shaft 11 is an adjusting element 16. The adjusting element 16 is axially movable. The adjusting element is offset through 90° with respect to the actuator pins 15. Alternatively, other angular offsets are conceivable. The adjusting element 16 comprises a first and a second coupling pin 17*a*, 17*b* and a receiving element 18. The first and the second coupling pin 17*a*, 17*b* are each arranged at an axial end of the adjusting element 16. The receiving element 18 comprises three extensions and is arranged between the axial ends of the adjusting element 16. The coupling pins 17*a*, 17*b* and the receiving element 18 extend orthogonally to the longitudinal center axis of the carrier shaft 11.

The first coupling pin 17*a* is assigned to the second shifting groove 14*b* of the primary sliding cam element 12*a*. The first and the second coupling pin 17*a*, 17*b* are arranged on the adjusting element 16 so as to be substantially rotatable. The first coupling pin 17*a* is permanently in engagement with the second shifting groove 14*b* of the primary sliding cam element 12*a*.

The first coupling pin 17*a* is subjected to a force by a flank of the second shifting groove 14*b*. The adjusting element 16 is displaced in the direction of action of the force. Since the adjusting element 16 and thus the coupling pins 17*a*, 17*b* are offset through 90° in the circumferential direction with respect to one another and the first and the second shifting groove 14*a*, 14*b* are arranged at an identical rotational angle, the displacement of the adjusting element 16 accordingly takes place in a time-offset or phase-shifted manner.

The second coupling pin 17*b* is arranged in the region of the first secondary sliding cam element 12*b*. The first secondary sliding cam element 12*b* comprises a shifting groove 14. The shifting groove 14 has a V-shaped portion. The second coupling pin 17*b* is permanently engaged with the shifting groove 14. The shifting groove 14 of the first secondary sliding cam element 12*b* is arranged such that it is possible to shift the first secondary sliding cam element 12*b* with a time offset with respect to the primary sliding cam element 12*a*.

As a result of the displacement of the adjusting element 16, the second coupling pin 17*b* is moved axially in the shifting groove 14. More specifically, the second coupling pin 17*b* is moved toward one of the flanks of the shifting groove 14. The second coupling pin 17*b* cooperates with the shifting groove 14 substantially in the same way as the actuator pins 15 cooperate with the first shifting groove 14*a* of the primary sliding cam element 12*a*.

The carrier shaft 11 comprises a locking element 19 in the form of a circular disk. Alternatively, other geometries are conceivable. The locking element 19 is arranged between the first and the first secondary sliding cam element 12*a*, 12*b*. The locking element 19 is axially delimited by the receiving element 18. The locking element 19 has a supporting function. The locking element 19 forms a counter bearing for the receiving element 18. The locking element 19 absorbs the forces during the shifting operation and thus allows the adjusting element 16 to be fixed. Furthermore, the cooperation of the receiving element 18 and the locking element 19 prevents the primary sliding cam element 12*a* from being unintentionally displaced. The receiving element 18 comprises two receptacles for the locking element 19. The locking element 19 comprises a cutout. As a result, it is possible for the adjusting element to be displaced through the circular disk. To this end, the cutout is arranged in the region of the corresponding rotational angle. The cutout is arranged in the circular disk such that, during an axial movement, the adjusting element 16 is moved through the cutout. It is conceivable for the adjusting element 16 to additionally comprise a spring/ball locking means (not illustrated).

In summary, the above-described sliding cam system, as a result of the adjusting element 16, allows phase-shifted shifting of the sliding cam elements 12*a*, 12*b* using a single actuator. As a result, the total number of actuators in the sliding cam system is able to be considerably reduced.

Figure 5:
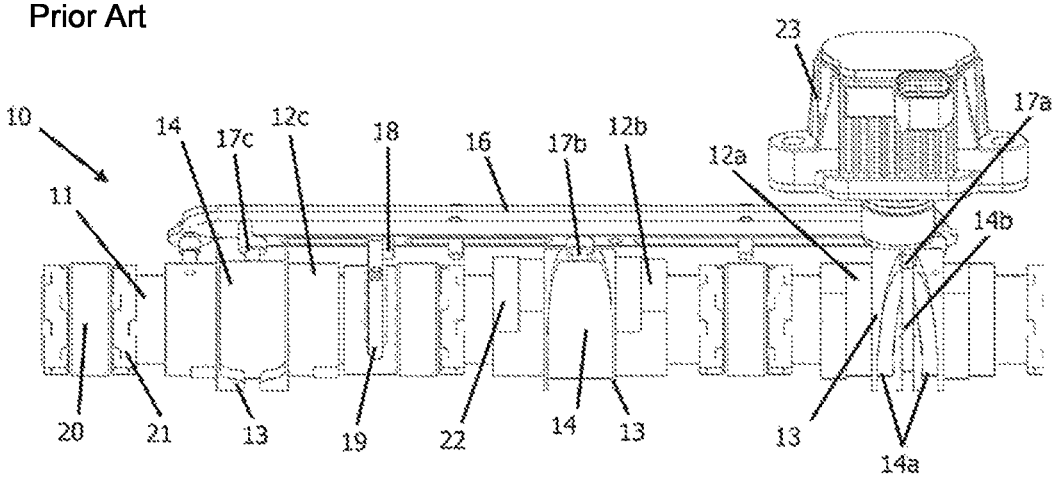
Fig. 5 Prior Art
FIG. 5 is a side view of a further exemplary embodiment of a sliding cam system according to the prior art.

FIG. 5 describes a further embodiment of a sliding cam system according to the prior art. The sliding cam system corresponds substantially to the sliding cam system according to FIGS. 1 to 4. The illustrated sliding cam system comprises, in contrast to the above-described system, a second secondary sliding cam element 12*c* and in particular the primary sliding cam element 12*a* has a differently shaped shifting gate.

Preferably, the locking element 19 is arranged between the second and the third sliding cam element 12*b*, 12*c*. The locking element 19 comprises a circular disk with a cutout. In the region of the circular disk, an extension is arranged on the adjusting element 16. The circular disk forms a counter bearing for the extension. The circular disk cooperates with the extension during a displacement movement such that the first coupling pin is relieved of load during the displacement movement. In other words, the extension is supported against the circular disk. The cutout is arranged at the rotational angle at which the displacement of the first adjusting element 16 takes place. An actuator is identified by the reference sign 23.

Figure 6:
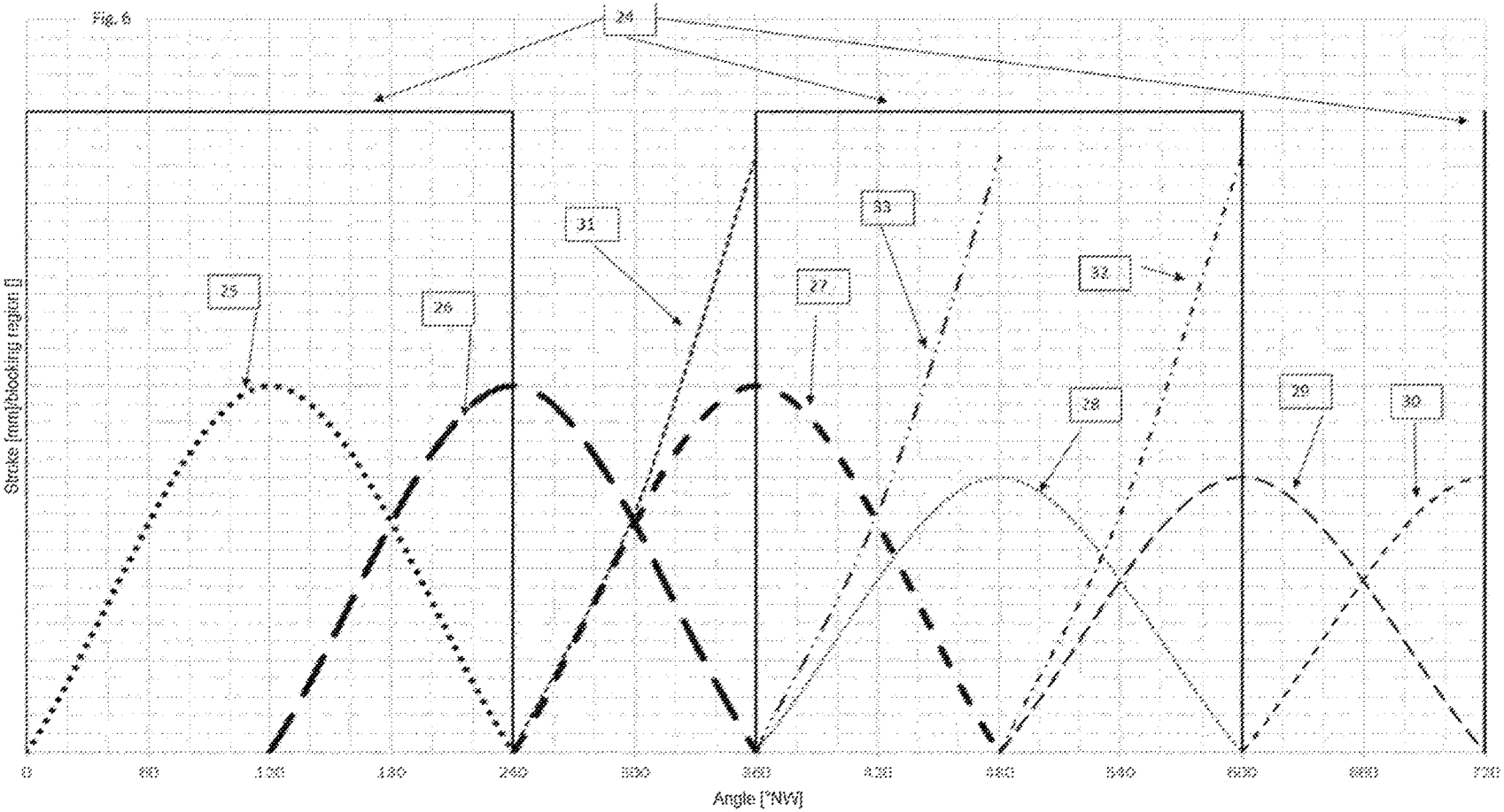
FIG. 6 is a "lift [mm]/blocking region [ ] over the angle [° NW]" diagram for a sliding cam system according to the prior art.

FIG. 6 illustrates "a "lift [mm]/blocking region [ ] over the angle [°NW]" diagram for a sliding cam system according to FIG. 5".

In the diagram according to FIG. 6, the valve lifts that result from the respective cam contours (large lift) of the embodiment of a sliding cam system according to the prior art according to FIG. 5 are indicated as "FL profile cyl. 1", "FL profile cyl. 2" and "FL profile cyl. 3".

In the diagram according to FIG. 6, the valve lifts that result from the respective cam contours (small lift) of the embodiment of a sliding cam system according to the prior art according to FIG. 5 are indicated as "PL profile cyl. 1", "PL profile cyl. 2" and "PL profile cyl. 3".

The blocking regions of the blocking disk or locking element 19 are also plotted in the diagram according to FIG. 6.

For further details and further embodiments, reference may be made to the applicant's PCT/EP2020/058182, or DE 10 2019 107 626.9, to which reference is expressly made here.

Further improvements with regard to the shifting of the sliding cam elements are described in the following text.

A preferred embodiment of the present invention is illustrated in FIGS. 7 to 18. The embodiment, described therein, of the sliding cam system according to the invention has a primary sliding cam element 12*a*, a first secondary sliding cam element 12*b* and a second secondary sliding cam element 12*c*. Furthermore, the locking element 19 can also be referred to as a blocking disk. Furthermore, the adjusting element 16 can also be referred to as a thrust rod.

The sliding cam elements each have a shifting groove 121*a*, 121*a*", 121*b*, 121*c*, meaning that the primary sliding cam element 12*a* has the shifting grooves 121*a* and 121*a*", the first secondary sliding cam element 12*b* has the shifting groove 121*b* and the second secondary sliding cam element 12*c* has the shifting groove 121*c*.

The shifting groove 121*a* is intended for the engagement of the actuator pins 15, whereas the shifting groove 121*a*" is intended for the engagement of the first shifting pin 17*a* of the connecting element 16.

The shifting groove 121*b* is accordingly provided for the engagement of the second shifting pin 17*b* and the shifting groove 121*c* is accordingly provided for the engagement of the third shifting pin 17*c*.

The operating principle as set out above; the primary sliding cam element 12*a* is axially displaced in a targeted manner into the shifting groove 121*a* via the actuator or the engagement of the actuator pin 15 during the rotation of the camshaft 10. The adjusting element 16 is axially displaced via the engagement of the first shifting pin 17*a* in the shifting groove 121*a*", with the result that the shifting pins 17*b* and 17*c* are likewise displaced in a corresponding manner.

The shifting groove 121*a* of the primary sliding cam element 12*a* has, in the circumferential direction, at least one displacement region 121*a*/S and a freewheel region 121*a*/F. The displacement region 121*a*/S is characterized in particular by a shifting groove side wall that is inclined with respect to the longitudinal axis/axis of rotation L of the primary sliding cam element 12*a* or carrier shaft. In other words, this is the region with which the primary element 12*a* and, as a result of the operative connection between the shifting groove 121*a*" and the shifting pin 17*a*, the connecting element 16 is axially displaced. The freewheel region is, by comparison, that region of the shifting groove 121*a* in which no axial displacement of the connecting element 16 takes place. The displacement region can also be referred to as a shifting region.

The shifting groove 121*b* of the first secondary sliding cam element 12*b* has, in the circumferential direction, at least one displacement region 121*b*/S and a freewheel region 121*b*/F. The displacement region 121*b*/S is characterized in particular by a shifting groove side wall that is inclined with respect to the longitudinal axis/axis of rotation L of the secondary sliding cam element 12*b* or carrier shaft. In other words, this is the region against which a displaced shifting pin 17*b* bears and displaces the secondary sliding cam element 12*b* axially in the desired direction. The freewheel region is, by comparison, that region of the shifting groove 121*b* in which no axial displacement of the secondary sliding cam element 12*b* takes place. This region is characterized in particular in that, during the movement of the connecting element, there is no contact with the shifting groove side wall.

To avoid repetitions, it may also be noted that the second secondary sliding cam element 12*c* and the shifting groove 121*c* thereof have a displacement region 121*c*/S and a freewheel region 121*c*/F. The shifting pin 17*c* of the adjusting element 16 engages in a corresponding manner here. With regard to the function, reference may be made to the preceding paragraph about the first secondary sliding cam element 12*b*.

The sliding cam elements each have at least two cam contours. One cam contour may also be in the form of a so-called zero lift cam. The cam contours differ from one another and result in particular in different lifts of the controlled valve (not illustrated).

The primary sliding cam element 12*a* has preferably a first cam contour 122*a* and a second cam contour 122*a*". The first secondary sliding cam element 12*b* has preferably a first cam contour 122*b* and a second cam contour 122*b*". The second secondary sliding cam element 12*c* has preferably a first cam contour 122*c* and a second cam contour 122*c*". No cam contour of the primary sliding cam element 12*a* has been illustrated in FIGS. 7 and 7*a* merely for clearer illustration. However, reference can be made to FIGS. 8 to 10 here.

The displacement regions can be defined more closely in terms of their angular length, and in terms of their start and their end.

Thus, the angular lengths:

- °NW 121*a*/S Angular length of the displacement region 121*a*/S of the first shifting groove 121*a* of the primary sliding cam element 12*a*
- °NW 121*a*/F Angular length of the freewheel 121*a*/F of the first shifting groove 121*a* of the primary sliding cam element 12*a*
- °NW 121*b*/S Angular length of the displacement region 121*b*/S of the shifting groove 121*b* of the first secondary sliding cam element 12*b*
- °NW 121*b*/F Angular length of the freewheel 121*b*/F of the shifting groove 121*b* of the first secondary sliding cam element 12*b*
- °NW 121*c*/S Angular length of the displacement region 121*c*/S of the shifting groove 121*c* of the second secondary sliding cam element 12*c*
- °NW 121*c*/F Angular length of the freewheel 121*c*/F of the shifting groove 121*c* of the second secondary sliding cam element 12*c* and the start and end of the displacement regions
- °NW121*a*/SA Start of the displacement region of the first shifting groove 121*a* of the primary sliding cam element 12*a*
- °NW121*a*/SE End of the displacement region of the first shifting groove 121*a* of the primary sliding cam element 12*a*
- °NW121*b*/SA Start of the displacement region of the shifting groove 121*b* of the first secondary sliding cam element 12*b*
- °NW121*b*/SE End of the displacement region of the shifting groove 121*b* of the first secondary sliding cam element 12*b*
- °NW121*c*/SA Start of the displacement region of the shifting groove 121*c* of the second secondary sliding cam element 12*c*
- °NW121*c*/SE End of the displacement region of the shifting groove 121*c* of the second secondary sliding cam element 12*c* can be designated as mentioned above.

The invention provides that the sliding cam system is designed such that a shifting operation of the first secondary sliding cam element 12*b* takes place at least partially at the same time as the shifting operation of the second secondary sliding cam element 12*c*.

The partially simultaneous shifting of the secondary sliding cam elements is understood according to the invention as follows: that the displacement regions of the respective secondary displacement gates are angularly oriented with respect to one another such that they have portions in which the coupling pin of the adjusting element for axially displacing the first secondary sliding cam element and the coupling pin of the adjusting element for axially displacing the second secondary sliding cam element are in operative contact at the same time (concurrently) such that an axial displacement of the second secondary cam element begins at least while the axial displacement of the first secondary sliding cam element is taking place.

The angular orientation, i.e. the arrangement and length of the respective corresponding displacement regions of the secondary gates are in this case always dependent on the type of motor or the respective installation space requirements of the internal combustion engine, for example the radial arrangement and position of the adjusting element.

The angular orientation, i.e. the arrangement and length of the respective corresponding displacement regions of the secondary gates are in this case always dependent on the type of motor or the respective installation space requirements of the internal combustion engine, for example the radial arrangement and position of the adjusting element.

Preferably, it may be provided that the sliding cam system is designed such that the shifting operation of the first secondary sliding cam element 12*b* begins immediately after the end of the shifting operation of the primary sliding cam element 12*a*, and that the shifting operation of the second secondary sliding cam element 12*c* begins after the beginning and before the end of the shifting operation of the first secondary sliding cam element 12*b*.

Further preferably, it may be provided that the sliding cam system is designed such that the beginning of the shifting operation of the first secondary sliding cam element 12*b* and the beginning of the shifting operation of the second secondary sliding cam element 12*c* take place at the same time.

Further preferably, it may be provided that the radial lengths of the displacement regions °NW121*a*/S, °NW121*b*/S and °NW121*c*/S (angular regions) of all the sliding cam elements 12*a*, 12*b*, 12*c* are the same, in particular that °NW121*a*/S=°NW121*b*/S=°NW121*c*/S.

Further preferably, it may be provided that the radial lengths of the displacement regions °NW121*a*/S, °NW121*b*/S and °NW121*c*/S (angular regions) of all the sliding cam elements 12*a*, 12*b*, 12*c* are different, in particular in that °NW121*a*/S≠°NW121*b*/S≠°NW121*c*/S.

Further preferably, it may be provided that the displacement regions of the sliding cam elements are greater than 120°NW, in particular that °NW121*a*/S>120° and °NW121*b*/S>120° and °NW121*c*/S>120°, respectively.

Further preferably, it may be provided that the sliding cam system is designed such that the offset of the shifting portion °NW121*b*/SA with respect to the cam start °NW122*b*/NA is not the same as the offset of the shifting portion °NW121*c*/SA with respect to the cam start °NW122*c*/NA.

Further preferably, it may be provided that the length of the displacement region °NW121*a*/S of the first shifting groove 121*a* on the primary sliding cam element 12*a* is greater than the length of the displacement regions °NW121*b*/S and °NW121*c*/S, respectively, of the shifting grooves 121*b* and 121*c*, respectively on the secondary sliding cam elements 12*b* and 12*c*, respectively.

Further preferably, it may be provided that the length of the displacement region °NW121*b*/S or °NW121*c*/S, respectively, of the shifting groove 121*b* or 121*c*, respectively, on at least one secondary sliding cam element 12*b* or 12*c*, respectively, is greater than the length of the displacement region °NW121*a*/S on the primary sliding cam element 12*a* and/or possibly further secondary sliding cam elements (°NW121*x*/S and 12*x*, respectively). The x stands here as an index for further secondary sliding cam elements.

Further preferably, it may be provided that more than two secondary sliding cam elements 12*b*, 12*c* are coupled to a connecting element 16, in particular in applications in internal combustion engines having more than 3 cylinders in a series arrangement. It may preferably be provided that the shifting groove on a secondary sliding element is larger than on the primary sliding element and/or larger than on at least one further secondary sliding element.

The sliding cam system is also usable for 5, 6, 8, 10, 12 cylinder internal combustion engines. The sliding cam system may also be configured with three (or more) stages with regard to the number of cam contours 122$x^y$. "X" stands here as an index for the respective sliding cam element, and "Y" stands here as an index for the respective cam contour.

Compared with a sliding cam system according to the prior art, as a result of the present invention, the length and the arrangement of the displacement grooves (region of the axial displacement) of the secondary shifting gates with regard to the respective cam tip is modified such that ultimately overlapping shifting of the secondary elements is achieved.

This can result, in the primary sliding cam element 12*a* and in the secondary sliding cam elements 12*b* and 12*c*, in an angular length of the displacement region 121*a*/S of the primary sliding cam element 12*a* of °NW121*a*/S>120°, an angular length of the displacement region 121*b*/S of the first secondary sliding cam element 12*b* of °NW121*b*/S>120° and/or an angular length of the displacement region 121*c*/S of the second secondary sliding cam element 12*c* of °NW121*c*/S>120°, in particular in an angular length °NW121*a*/S, °NW121*b*/S, °NW121*c*/S of the displacement regions 121*a*/S, 121*b*/S, 121*c*/S of the shifting grooves 121*a*, 121*b*, 121*c* of, for example, 153°NW each.

It may furthermore preferably be provided that the angular position of the displacement region with respect to the respective cam tip is different for the secondary sliding cam elements, in particular that °NW121*b*/SA with respect to °NW122*b*/NA is not the same as °NW121*c*/SA with respect to °NW122*c*/NA.

It may furthermore preferably be provided that secondary sliding cam elements are not identical parts, in particular in terms of the displacement region (arrangement, length) and/or cam contour (arrangement, length).

The arrangement of the displacement regions with respect to the respective cam tip should be different, and the length may be different. If the secondary cams have different mass properties, the shifting behavior may for example be adapted such that the length of the shifting grooves is coordinated with the mass.

In a particular and preferred configuration of the invention, it may be provided that the beginning of the shifting portion °NW121*b*/SA with respect to the cam tip NS122*b* of the first secondary sliding cam amounts to 143° and the beginning of the shifting portion NW121*c*/SA with respect to the cam tip NS122*c* of the second secondary sliding cam amounts to 203°, in other words that the angular position of the displacement region with respect to the respective cam tip is different for the secondary sliding cam elements, in particular that °NW121*b*/SA with respect to NS122*b* is not the same as °NW121*c*/SA with respect to NS122*c*.

It may furthermore preferably be provided that the cam contours of the secondary sliding cam elements are arranged identically, in particular are arranged so as to be offset at an angle, for example offset at 120°, only in accordance with the ignition sequence, and are embodied identically with regard to the cam contour. However, depending on the thermodynamic demand, both the arrangement and the cam profile shape/cam profile length may differ.

Figure 7:
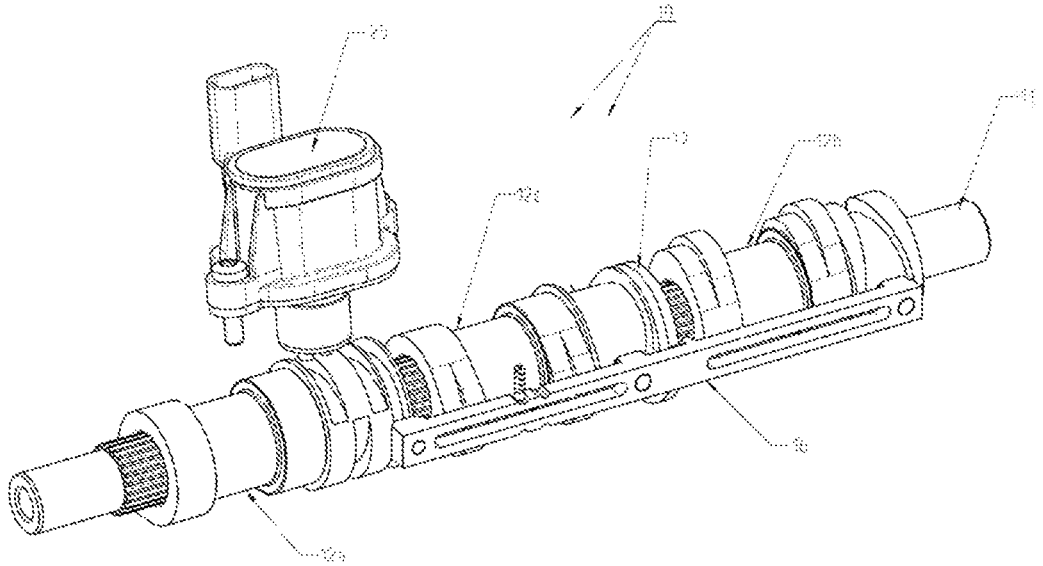
FIG. 7 is a perspective view of an embodiment of a sliding cam system according to the invention.
Figure 7A:
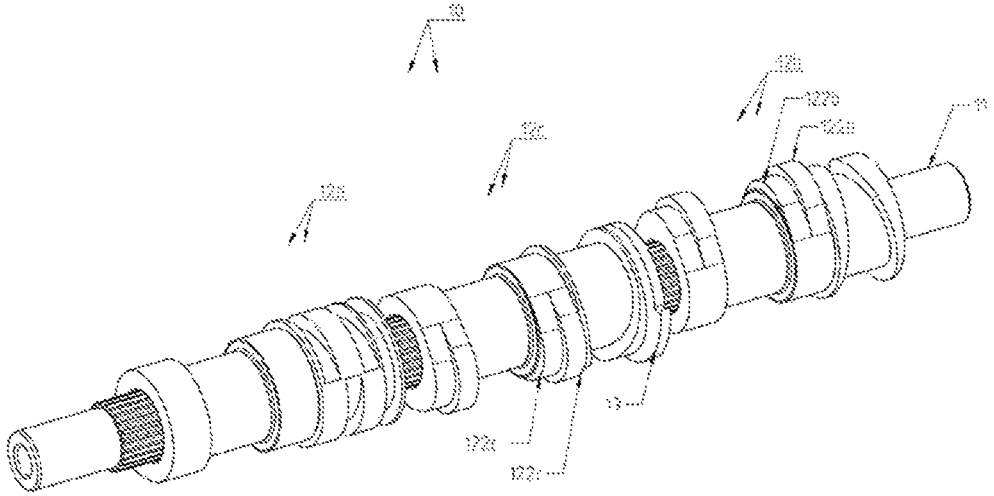
FIG. 7*a* is a perspective view of a camshaft of an embodiment of a sliding cam system according to the invention.
Figure 8:
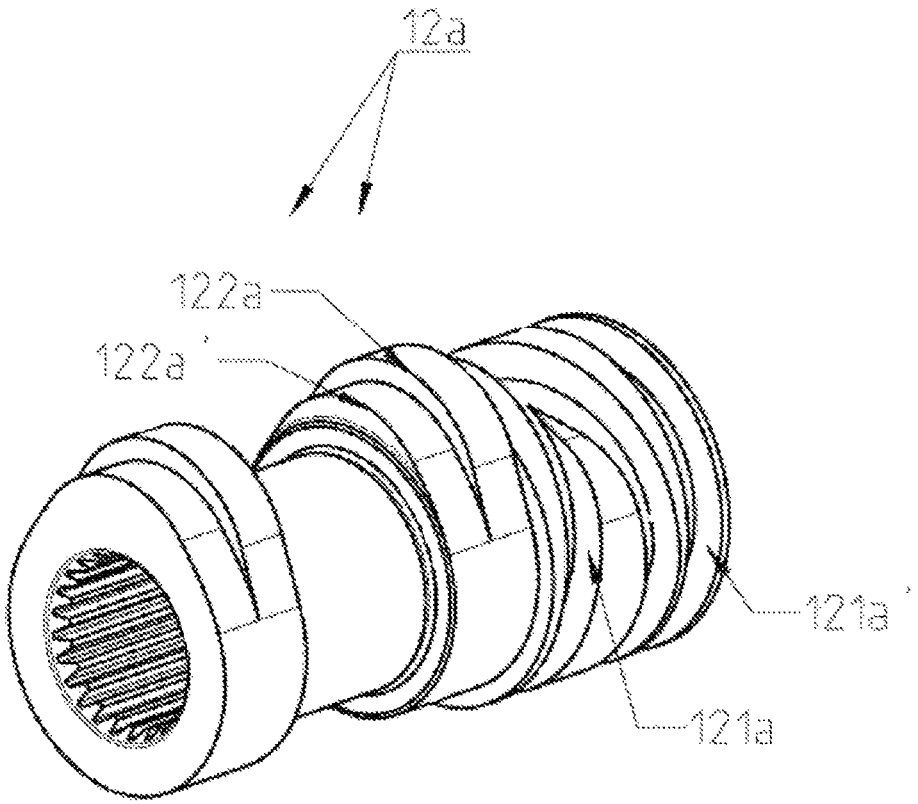
FIG. 8 is a perspective view of a primary sliding cam element of a sliding cam system according to the invention.
Figure 9:
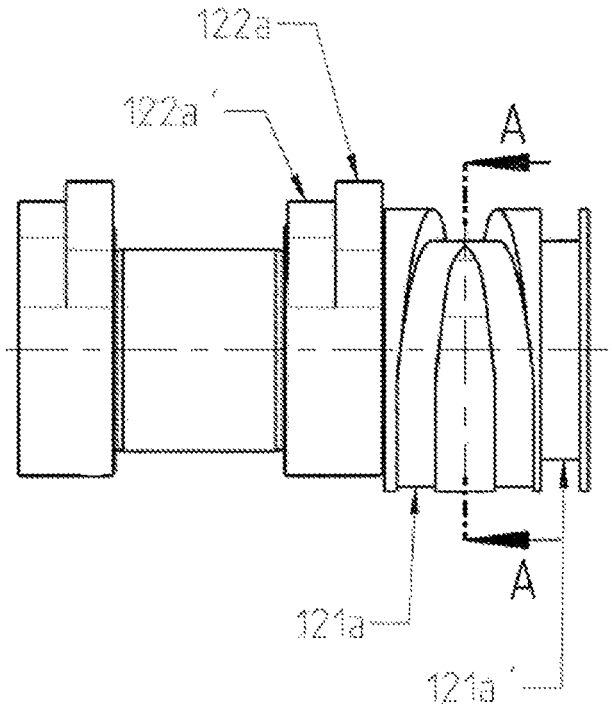
FIG. 9 is a side view of a primary sliding cam element of a sliding cam system according to the invention.
Figure 10:
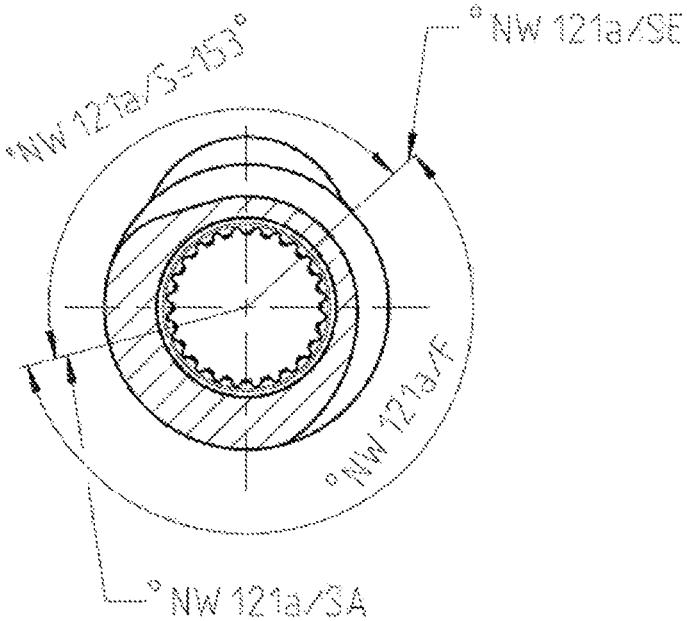
FIG. 10 is a section A-A according to FIG. 9.
Figure 11:
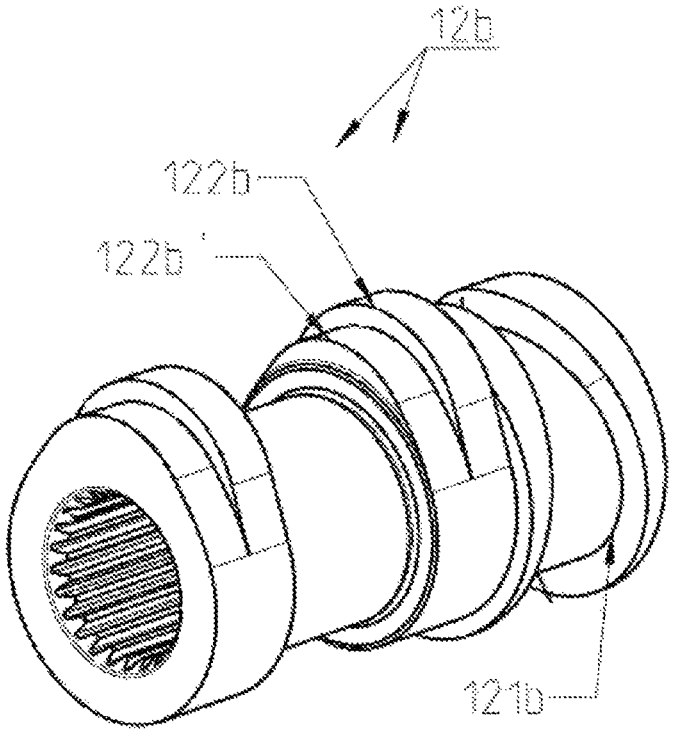
FIG. 11 is a perspective view of a first secondary sliding cam element of a sliding cam system according to the invention.
Figure 12:
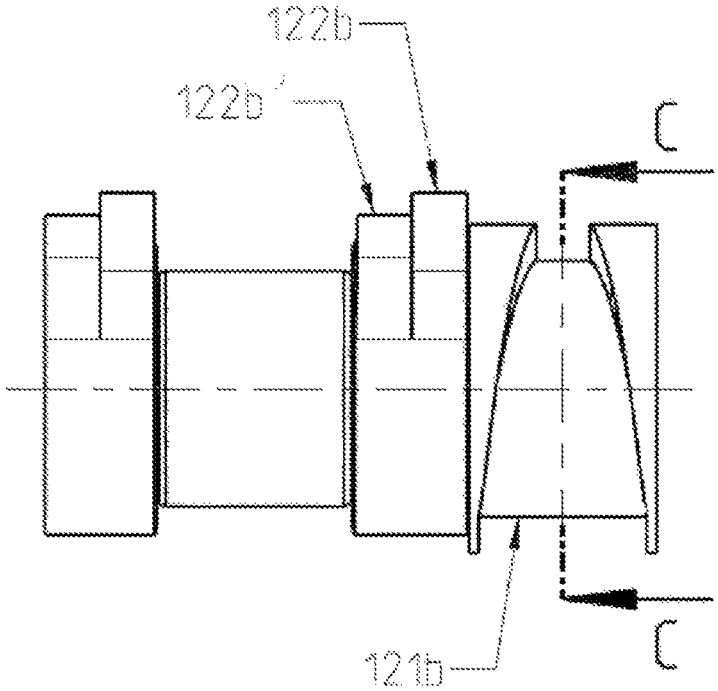
FIG. 12 is a side view of a first secondary sliding cam element of a sliding cam system according to the invention.
Figure 13:
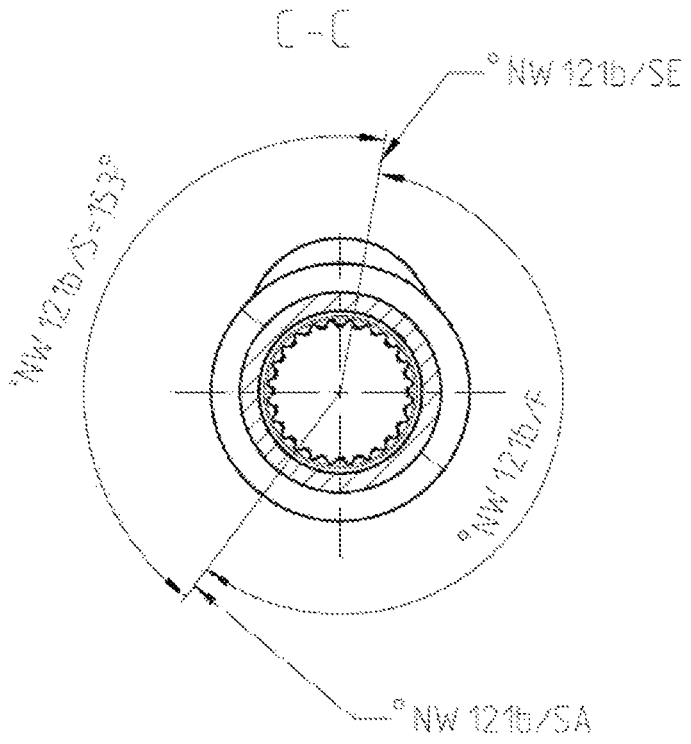
FIG. 13 is a section C-C according to FIG. 12.
Figure 13A:
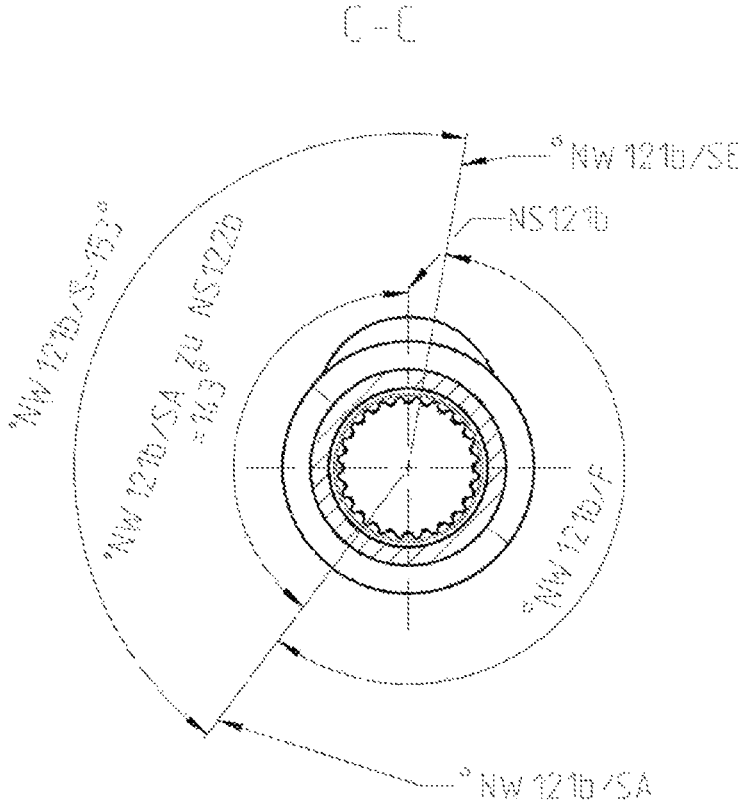
FIG. 13*a* is a further section C-C according to FIG. 12.
Figure 14:
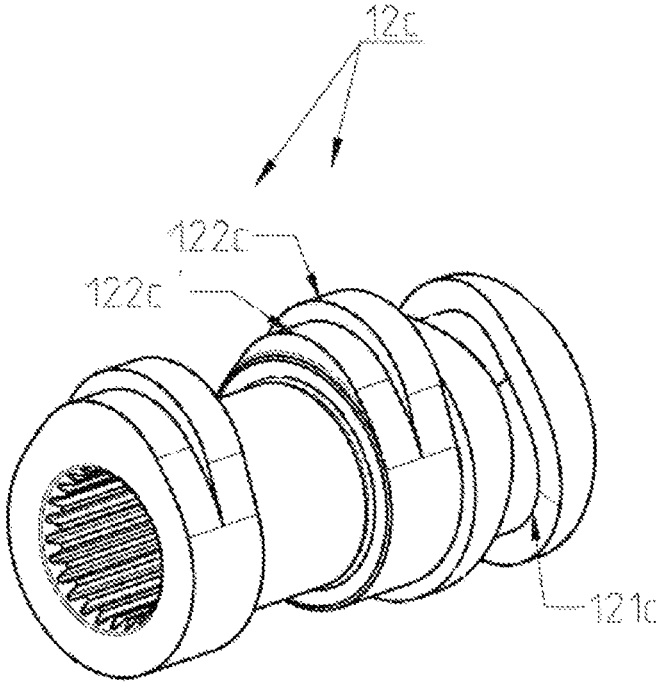
FIG. 14 is a perspective view of a second secondary sliding cam element of a sliding cam system according to the invention.
Figure 15:
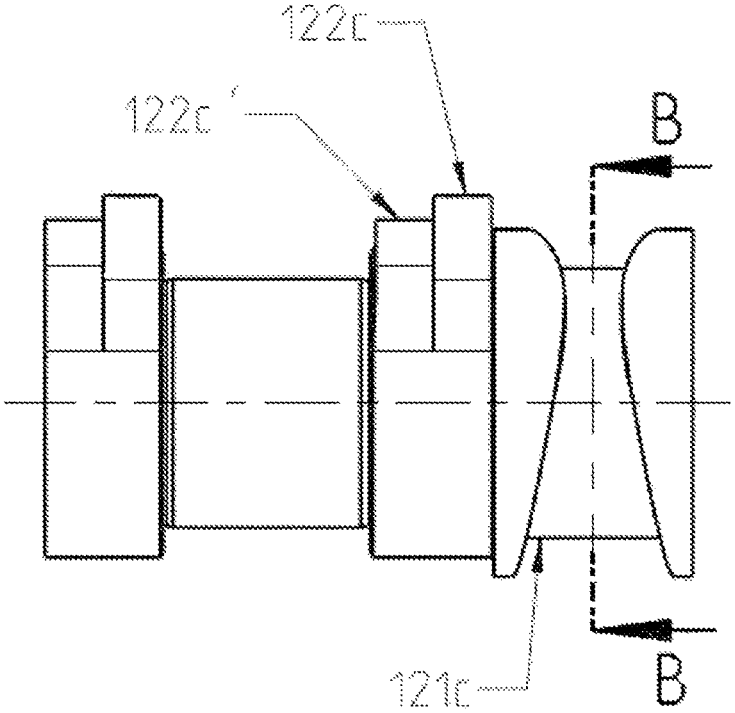
FIG. 15 is a side view of a second secondary sliding cam element of a sliding cam system according to the invention.
Figure 16:
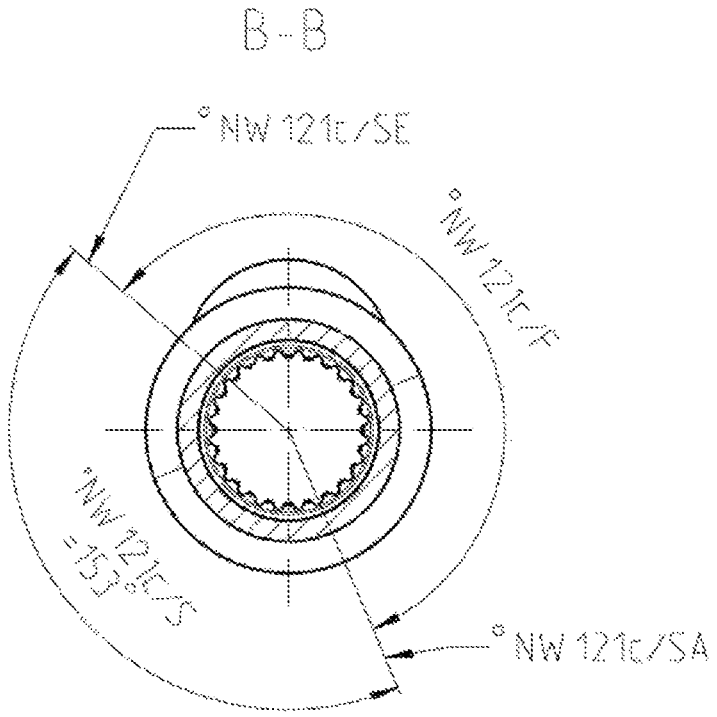
FIG. 16 is a section B-B according to FIG. 15.
Figure 16A:
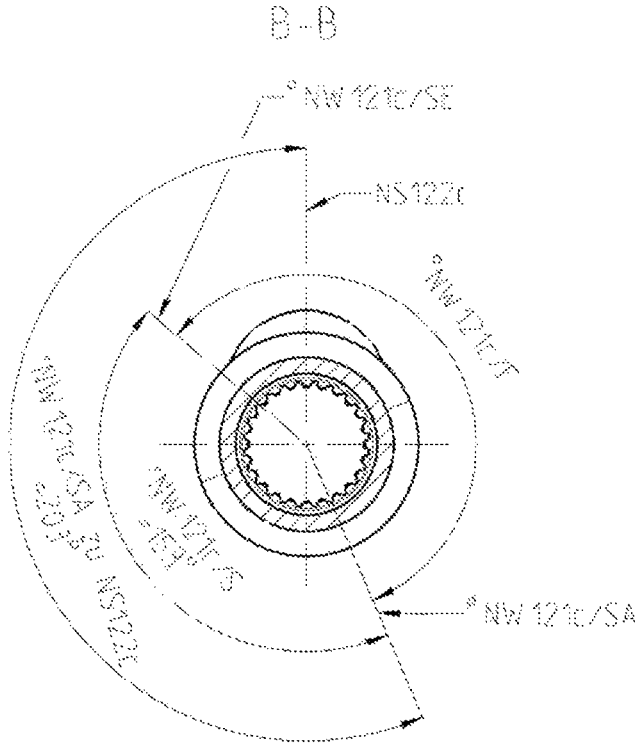
FIG. 16*a* is a further section B-B according to FIG. 15.
Figure 17:
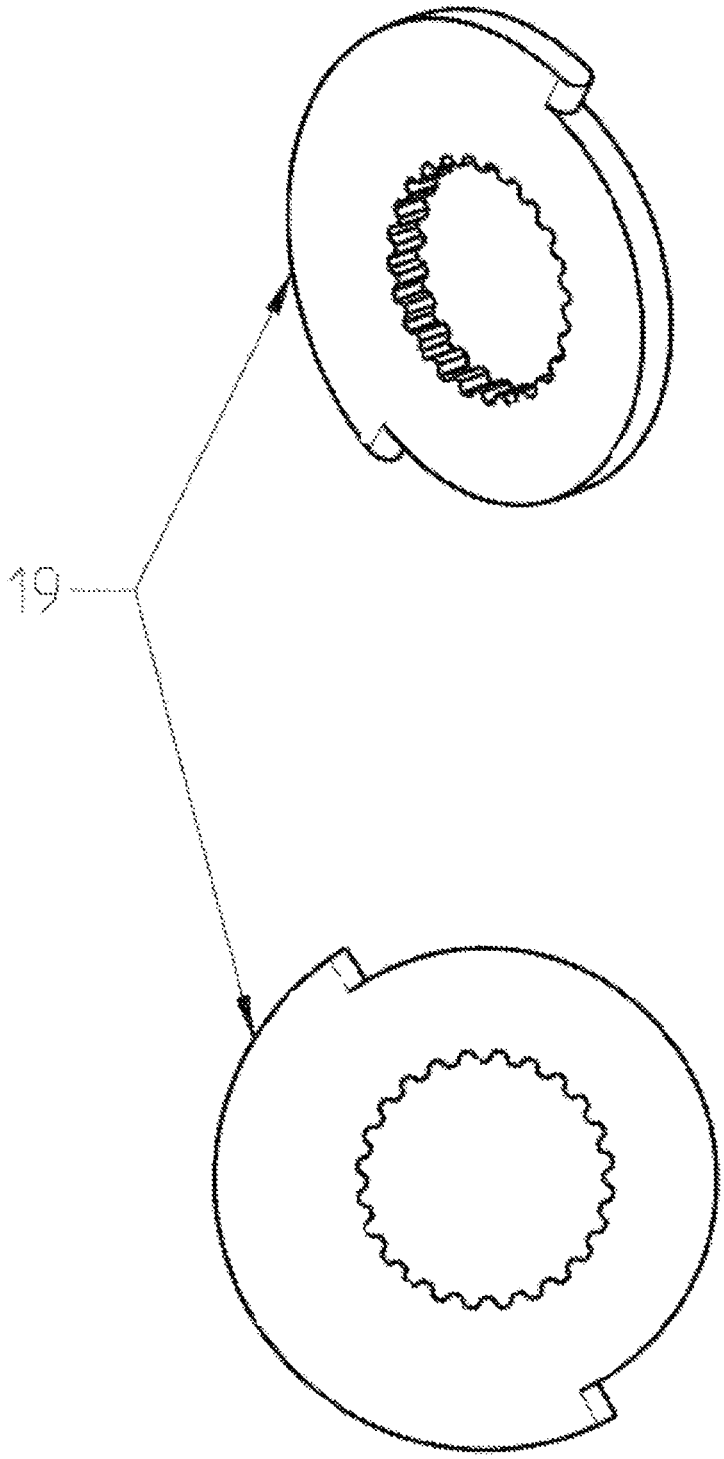
FIG. 17 is a locking element (blocking disk) for a sliding cam system according to the invention.

In particular with regard to the ""lift [mm]/blocking region [ ] over the angle [°NW]" diagram for a sliding cam system according to the invention according to FIG. 7" (FIG. 18) it is clearly apparent that the shifting operation of the primary sliding cam element 12*a* should be concluded before the shifting operation of a secondary sliding cam element 12*b*, 12*c* can take place. This is attributable in particular to the function of the blocking disk 19.

Figure 18:
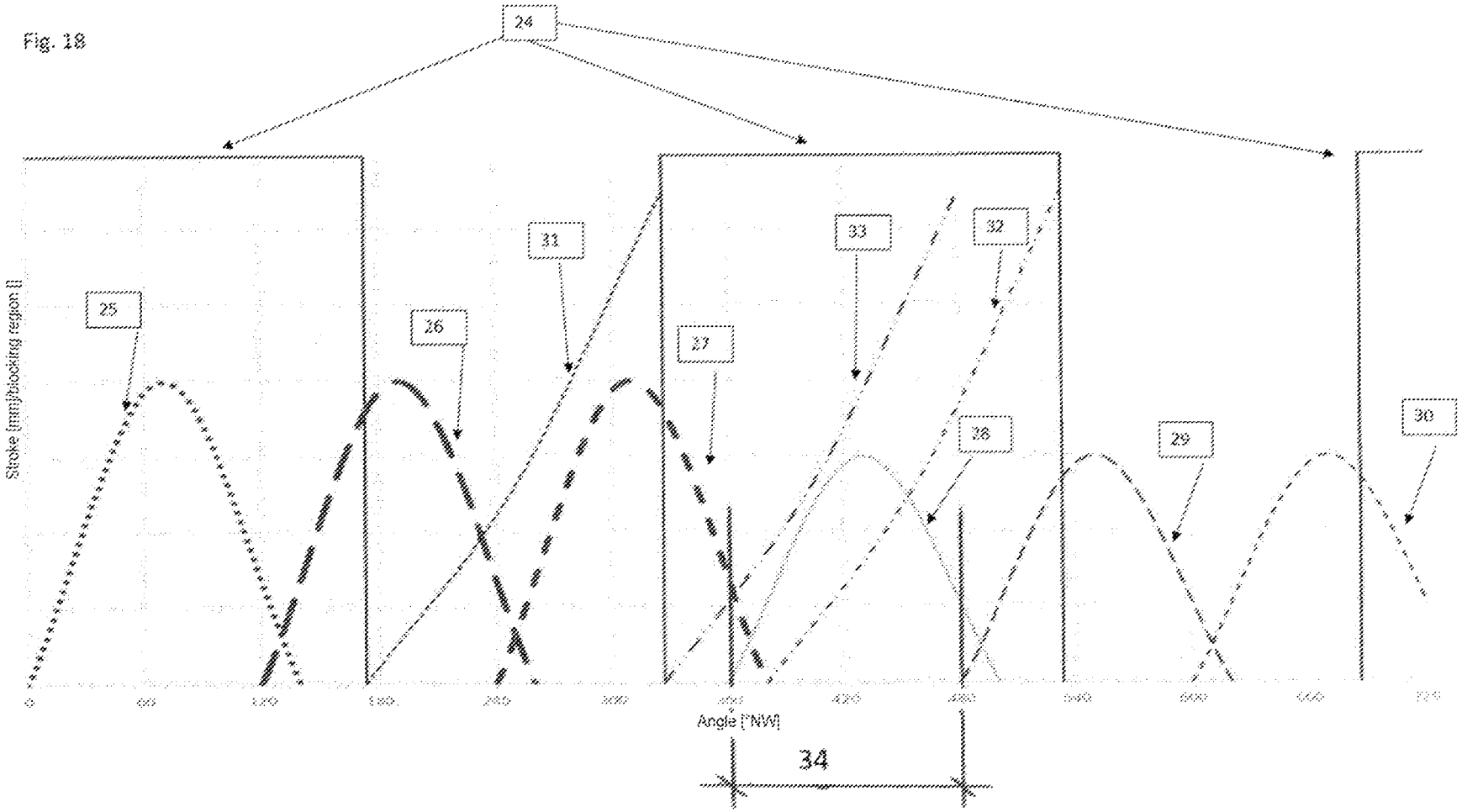
FIG. 18 is a "lift [mm]/blocking region [ ] over the angle [° NW]" diagram for a sliding cam system according to the invention according to FIG. 7.

Furthermore, with regard to the diagram according to FIG. 18, it is readily apparent here that the shifting operation or the axial displacement of a first secondary sliding cam element 12*b* begins immediately after the end of the shifting operation of the primary sliding cam element. The shifting operation of a further (second) secondary sliding cam element begins preferably after the beginning and before the end of the shifting operation of the first secondary sliding cam element. In an extreme case, the first secondary sliding cam element and the one or more further secondary sliding cam elements are shifted at the same time—the beginning of the shifting operations takes place at the same time.

In the diagram according to FIG. 18, the valve lifts that result from the first cam contours 122*a*, 122*b* and 122*c* are indicated as "FL profile cyl. 1", "FL profile cyl. 2" and "FL profile cyl. 3".

In the diagram according to FIG. 18, the valve lifts that result from the first cam contours 122*a*", 122*b*" and 122*c*" are indicated as "PL profile cyl. 1", "PL profile cyl. 2" and "PL profile cyl. 3".

The blocking regions of the blocking disk or locking element 19 are also plotted in the diagram according to FIG. 18.

A "region of simultaneity of the axial movement of the secondary sliding cam elements" has also been plotted as BG. Here, the overlapping, essential to the invention, of the axial displacement of the secondary sliding cam elements is apparent.

It is also apparent, but not inherently essential to the invention, that the valve lifts that result from the first cam contours 122*a*, 122*b*, 122*c* as "FL profile cyl. 1", "FL profile cyl. 2" and "FL profile cyl. 3" and the valve strokes that result from the first cam contours 122*a*", 122*b*" and 122*c*" as "PL profile cyl. 1", "PL profile cyl. 2" and "PL profile cyl. 3" temporally overlap.

Features and details that are described in conjunction with a method self-evidently also apply in conjunction with the device according to the invention and vice versa, such that reference is always or can always be made reciprocally with respect to the disclosure of the individual aspects of the invention. Furthermore, an optionally described method according to the invention can be carried out with the device according to the invention.

What is claimed is:

1. A sliding cam system for an internal combustion engine, the sliding cam system comprising:

at least one camshaft, comprising a carrier shaft with at least one primary sliding cam element, a first secondary sliding cam element and at least one second secondary sliding cam element, the primary sliding cam element, the first secondary cam element, and the secondary sliding cam element each comprise a shifting gate with at least one shifting groove, wherein the primary sliding cam element is displaceable axially with respect to the carrier shaft by at least one actuator pin and at least one adjusting element is arranged parallel to a longitudinal axis of the carrier shaft, wherein the adjusting element is displaceable axially in a direction of the longitudinal axis of the carrier shaft, wherein the adjusting element has at least three coupling pins, wherein a first coupling pin of the at least three coupling pins is arranged in a region of the primary sliding cam element and a second coupling pin of the at least three coupling pins is arranged in a region of the first secondary sliding cam element and a third coupling pin of the at least three coupling pins is arranged in a region of the second secondary sliding cam element and the first coupling pin, the second coupling pin, and the third coupling pin each cooperate with a shifting gate of a respectively associated sliding cam element of the primary sliding cam element, the first secondary sliding cam element, and the second secondary sliding cam element such that a movement of the primary sliding cam element initiated by the actuator pin is transmissible to the first secondary sliding cam element and the second secondary sliding cam elopement by the adjusting element, wherein the sliding cam system is configured such that a shifting operation of the first secondary sliding cam element takes place at least partially at a same time as a shifting operation of the second secondary sliding cam element.

2. The sliding cam system as claimed in claim 1, wherein the sliding cam system is configured such that the shifting operation of the first secondary sliding cam element begins immediately after an end of a shifting operation of the primary sliding cam element, and in that the shifting operation of the second secondary sliding cam element begins after the beginning of the shifting operation of the first secondary sliding cam element and before an end of the shifting operation of the first secondary sliding cam element.

3. The sliding cam system as claimed in claim 2, wherein the sliding cam system is configured such that the beginning of the shifting operation of the first secondary sliding cam element and the beginning of the shifting operation of the second secondary sliding cam element take place at a same time.

4. The sliding cam system as claimed in claim 3, wherein ° NW121*a*/S is an angular length of a displacement region of the primary sliding cam element, ° NW121*b*/S is an angular length of a displacement region of the first secondary sliding cam element, ° NW121*c*/S is an angular length of a displacement region of the second secondary sliding cam element, and the angular lengths of the displacement regions of the sliding cam elements are the same, such that ° NW121*a*/S=° NW121*b*/S=° NW121*c*/S.

5. The sliding cam system as claimed in claim 3, wherein ° NW121*a*/S is an angular length of a displacement region of the primary sliding cam element, ° NW121*b*/S is an angular length of a displacement region of the first secondary sliding cam element, ° NW121*c*/S is an angular length of a displacement region of the second secondary sliding cam element, and the angular lengths of the displacement regions of all the sliding cam elements are different, such that ° NW 121*a*/S≠° NW 121*b*/S≠° NW 121*c*/S.

6. The sliding cam system as claimed in claim 3, wherein ° NW121*a*/S is an angular length of a displacement region of the primary sliding cam element, ° NW121*b*/S is an angular length of a displacement region of the first secondary sliding cam element, ° NW121*c*/S is an angular length of a displacement region of the second secondary sliding cam element, and the angular lengths of the displacement regions of the sliding cam elements are greater than 120° such that ° NW121*a*/S>120° and ° NW121*b*/S>120° and ° NW121*c*/S>120°, respectively.

7. The sliding cam system as claimed in claim 3, wherein ° NW121*b*/SA is a start of a displacement region of the first secondary sliding cam element, ° NW122*b*/NA is a start of a first cam contour of the first secondary sliding cam element, ° NW121*c*/SA is a start of a displacement region of the second secondary sliding cam element, ° NW122*c*/NA is a start of a first cam contour of the second secondary sliding cam element and the sliding cam system is configured such that a beginning of the displacement region ° NW121*b*/SA with respect to the start of the first cam contour of the first secondary sliding cam element ° NW122*b*/NA is not the same as a beginning of the displacement region ° NW121*c*/SA with respect to the start of the first cam contour of the second secondary sliding cam element ° NW122*c*/NA.

8. The sliding cam system as claimed in claim 7, wherein the beginning of the displacement region ° NW121*b*/SA with respect to a cam tip of the first secondary sliding cam element is offset by 143° and the beginning of the displacement region NW121*c*/SA with respect to a cam tip of the second secondary sliding cam element is offset by 203°.

9. The sliding cam system as claimed in claim 3, wherein a length of a displacement region of the first shifting groove of the at least one shifting groove on the primary sliding cam element is greater than a length of a displacement region of the at least one shifting groove on the first secondary sliding cam element and the displacement region of the first shifting groove on the primary sliding cam element is greater than a length of a displacement region of the at least one shifting groove on the second secondary sliding cam element.

10. The sliding cam system as claimed in claim 3, wherein a length of a displacement region of the at least one shifting groove on at least one of the secondary sliding cam elements is greater than a length of a displacement region on the primary sliding cam element and/or further secondary sliding cam elements.

11. The sliding cam system as claimed in claim 3, wherein more than the two secondary sliding cam elements are coupled to a connecting element.

12. The sliding cam system as claimed in claim 3, wherein displacement regions and/or cam contours of the secondary sliding cam elements are not identical.

13. The sliding cam system as claimed in claim 3, wherein cam contours of the secondary sliding cam elements are arranged identically so as to be offset at an angle in accordance with an ignition sequence, and are configured identically with regard to contour.

14. The sliding cam system as claimed in claim 3, wherein the sliding cam system is configured such that the shifting operation of the primary sliding cam element ends before the shifting operation of the second secondary sliding cam element takes place.

15. The sliding cam system as claimed in claim 3, wherein a shifting operation of a further (second) secondary sliding cam element begins after the beginning of the shifting operation of the first secondary sliding cam element and before the end of the shifting operation of the first secondary sliding cam element.

* * * * *